United States Patent [19]

Mall et al.

[11] 3,964,409

[45] June 22, 1976

[54] DEVICE FOR SEWING AND CUTTING-OPEN TUCKS ON CUT PIECES OF GARMENTS

[75] Inventors: Gunther Mall; Werner Striegler, both of Kaiserslautern, Germany

[73] Assignee: Pfaff Industriemaschinen GmbH, Germany

[22] Filed: Sept. 18, 1974

[21] Appl. No.: 507,135

[30] Foreign Application Priority Data

Oct. 12, 1973 Germany ..... 7336850

[52] U.S. Cl. ..... 112/121.15; 83/508

[51] Int. Cl.[2] ..... D05B 37/08

[58] Field of Search ..... 112/121.15, 127, 129, 112/121.14; 83/508, 176

[56] References Cited

UNITED STATES PATENTS

| | | | |
|---|---|---|---|
| 249,734 | 11/1881 | Arnold | 83/508 X |
| 1,796,463 | 3/1931 | Kaltenbach et al. | 83/508 |
| 2,566,639 | 9/1951 | Shreve | 83/444 |
| 3,808,992 | 5/1974 | Mall | 112/121.15 |

*Primary Examiner*—Werner H. Schroeder
*Assistant Examiner*—Peter Nerbun
*Attorney, Agent, or Firm*—McGlew and Tuttle

[57] ABSTRACT

A device for use on a sewing unit in sewing and cutting-open tucks on cut pieces of garments, comprises a sewing machine having a stitch formation zone which operates in conjunction with a work advance table. The work advance table has an edge around which the work is folded and a template rail is supported from the support for the work table and includes a pressure plate portion which may be moved into association with the work and a template rail which provides a guide for the feeding of the work piece into association with the sewing needle so that the shape of the seam may be followed. The apparatus includes a cutting knife which is carried on a carrier plate which is pivotable backwardly and forwardly. The cutting knife comprises a rotatable cutting blade which is rotated by a motor on the pivotal carrier plate. The carrier plate also provides a pivotal support for a guide spur which is in the form of a wedge-shaped plate which has a slot therein through which the blade extends and which includes an outer knife-like edge which engages into the space between the two materials. For this purpose, the work advance table is formed at least partly with a forked cross-section having spaced apart top and bottom legs defining a slot therebetween or an opening for the introduction of the guide spur so that the cutter is guided along the edge of the fabric to effect its cutting operation.

5 Claims, 7 Drawing Figures

W
a
V
S
Z
A
I
II

W
65
66
67
70
68
7
53

58
59
60
61
49
47
50
48
44
2
63
64
84
87
62
51
52
57
56
55
65
67
53
35
37
32
33
38
42
40
91
85
92
90
46
45

DEVICE FOR SEWING AND CUTTING-OPEN TUCKS ON CUT PIECES OF GARMENTS

FIELD AND BACKGROUND OF THE INVENTION

This invention relates in general to the construction of sewing units and, in particular, to a new and useful automatic feed sewing machine unit which includes a device for cutting-open tucks on cut pieces of garment.

DESCRIPTION OF THE PRIOR ART

In a known device for sewing and cutting-open tucks, the fabric layers which are folded along a predetermined line of the cut piece are conveyed into a U-shaped guide having a web formed with a longitudinal slot for a circular knife rotating in a horizontal plane between the fabric layers of the tuck by which, during the sewing operation, the tuck is cut open along its fold edge while the fabric layers are backed on the outside against yielding by the free legs of the guide.

This method leads to satisfactory results in the working of relatively stiff materials. However, it is not suitable for thin and loosely woven fabric, since due to its small inherent stiffness, such a fabric is pushed off the circular path of the cutting edge by the knife and, consequently, cannot be cut open along the predetermined cutting line. Also, in the known device, if cut pieces of materials, having unequal thicknesses are to be worked sequentially, the unchangeable vertical position of the U-shaped guide and the equally unchangeable circular path of the cutting knife have a particularly unfavorable effect.

SUMMARY OF THE INVENTION

The inventive innovation provides an improved guide device for the fold edge of tucks ensuring a secure guidance of the fold edge of the tuck for a completely satisfactory operation of the cutting knife independently of the thickness and nature of the material to be worked and securely preventing a yielding relative to the cutting knife.

In accordance with the invention, the work advance table is formed in the marginal zone of one of its edges, at least partly, with a forked cross-section for introducing and guiding a guide spur for the fold edge of the tuck, which is introduceable between the fabric layers of the folded work. A space saving arrangement is obtained by a pivotal mounting of the guide spur on the drive shaft of the cutting knife. The cutting result is further improved by the provision that, in accordance with a development of the invention, the guide spur forms the counterblade for the cutting knife.

To facilitate the change of the cutting knife and to enable the entire device, when not used, to be brought into a non-operative position in a simple manner, the support of the cutting knife is adapted to accommodate the driving means of the knife and is mounted for pivotal movement about both a horizontal and a vertical axis.

The manufacture of the work advance table advantageously provides that the forked cross-section is formed on an insert which is secured to the advance table.

Accordingly, it is an object of the invention to provide an improved device for guiding fabric into association with a reciprocating needle in a sewing machine for effecting the cutting of a defined pattern of seam stitch and for simultaneously guiding a cutting knife along the folded edge of the work piece material and which includes a spur which enters into the fold between the material and has a slot therein for accommodating a rotating knife therein which is advanced with the spur.

A further object of the invention is to provide a device for cutting into material which has been folded along the fold line and which comprises a carrier plate which is pivotally mounted on a table, for example, in a sewing machine unit, and which includes a rotatable blade which is driven by a motor carried on the carrier plate and wherein the rotating blade is covered around at least a portion of the periphery by a guide spur which has a pointed end for engagement between the fabric material and a trailing slotted end through which the knife extends and which is guided between the adjacent legs of the spur during the cutting operation.

A further object of the invention is to provide a sewing machine unit which includes an advancing work table having an edge with a slot therein around which the material to be worked upon is folded so as to accommodate a spur and a cutting knife which may be advanced along the seam to cut the seam when the work table is advanced relatively thereto.

A further object of the invention is to provide a sewing machine unit and a device for cutting edge seams of material which are simple in design, rugged in construction and economical to manufacture.

For an understanding of the principles of the invention, reference is made to the following description of a typical embodiment thereof as illustrated in the accompanying drawings.

DESCRIPTION OF THE PREFERRED EMBODIMENT

Figure 1:
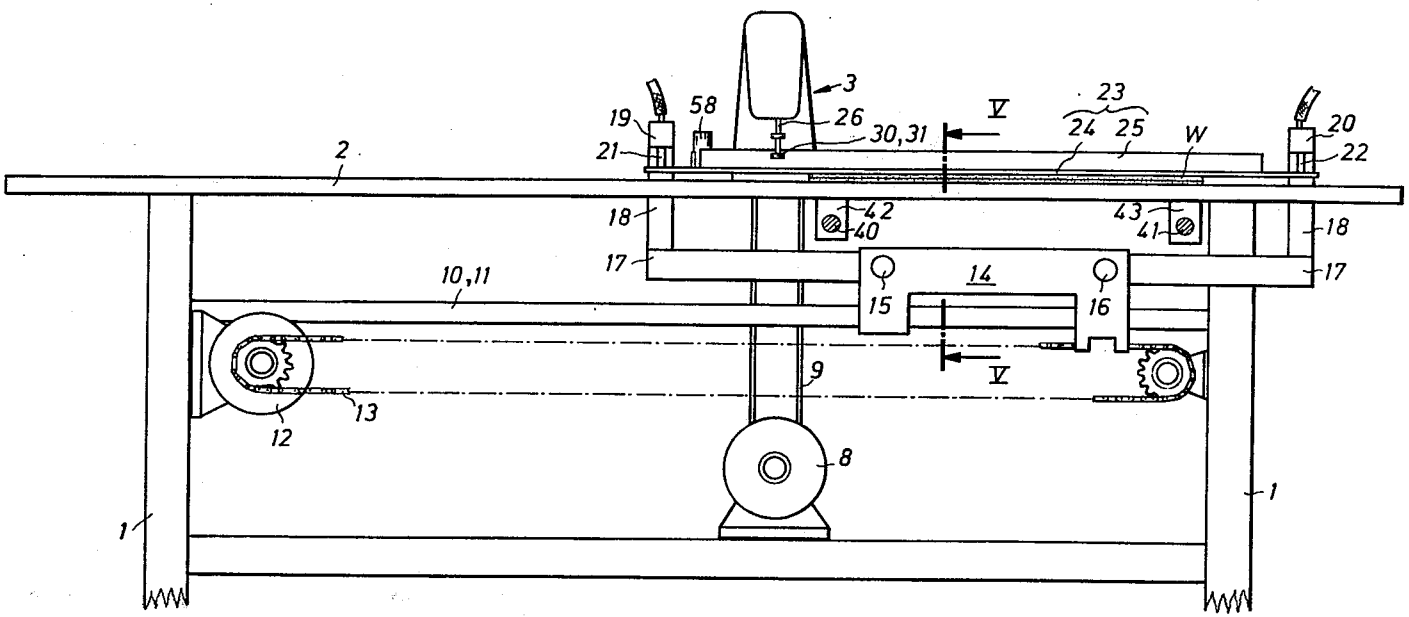
FIG. 1 is a simplified front elevational view of a sewing unit having a device for sewing and cutting-open tucks on cut pieces of garments constructed in accordance with the invention.

Referring to the drawings in particular, the invention embodied therein, comprises a sewing unit having a device for sewing and cutting-open tucks on cut pieces of garments. The sewing unit serving to illustrate the use of a device in accordance with the invention comprises a frame 1 and a table plate 2. A sewing machine 3, including a work supporting bed 4, is mounted in an opening of the table plate 2. The needle bar 6 which is reciprocable up and down in a well-known manner is mounted in the head of the sewing machine. On its lower end, needle bar 6 carries a needle 7 which cooperates in the usual manner with a shuttle (not shown) to form double back or chain-stitches. A sewing machine drive motor 8 is mounted on frame 1 and is connected to the sewing machine 3 by means of a drive belt 9.

Figures 2, 7:
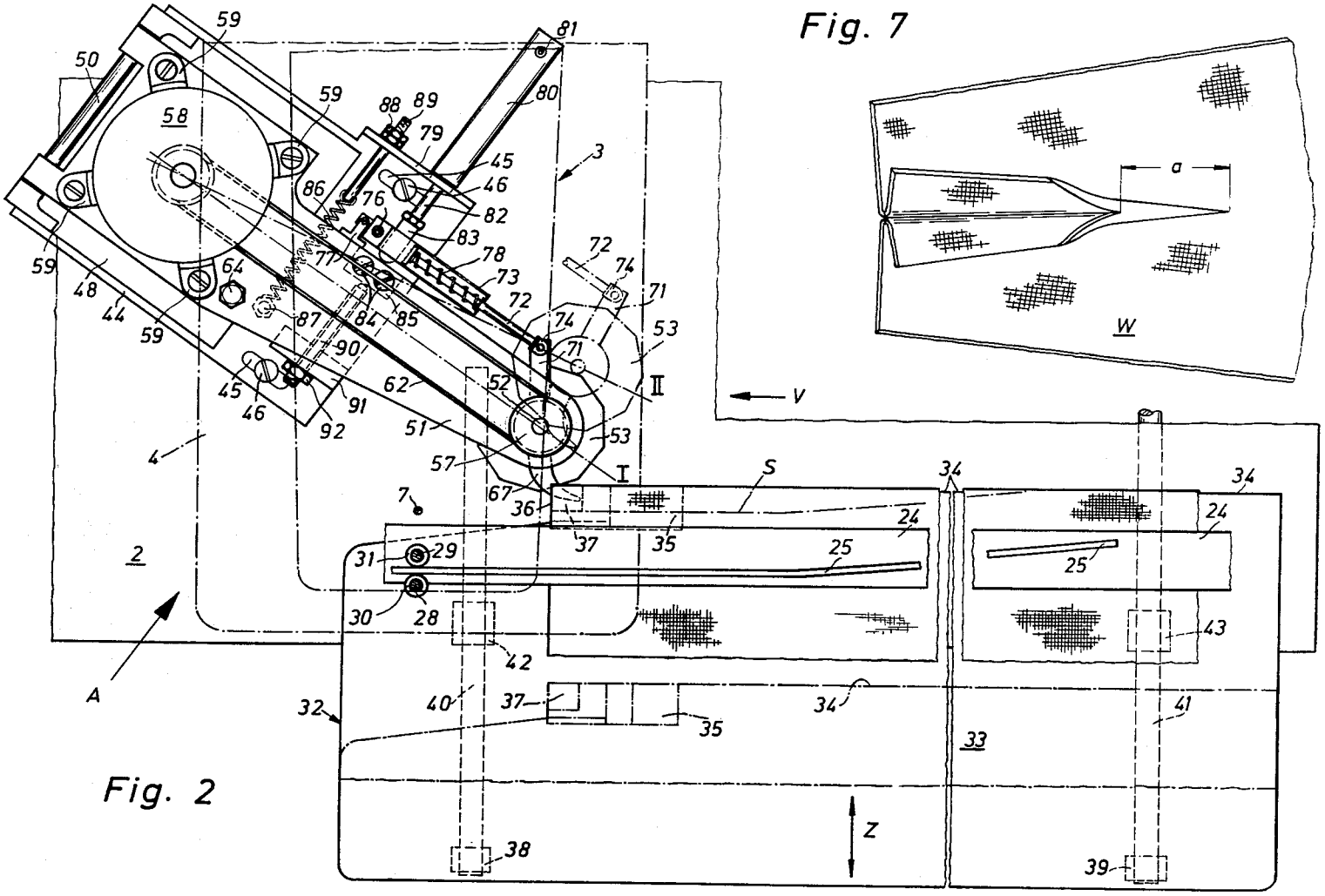
FIG. 2 is a partial top plan view of the machine shown in FIG. 1 showing the support for the cutting tool and the guide spur and drive therefor.
FIG. 7 is a partial top plan view with a tuck made with the device in accordance with the invention in a state after flat ironing.
Figure 6:
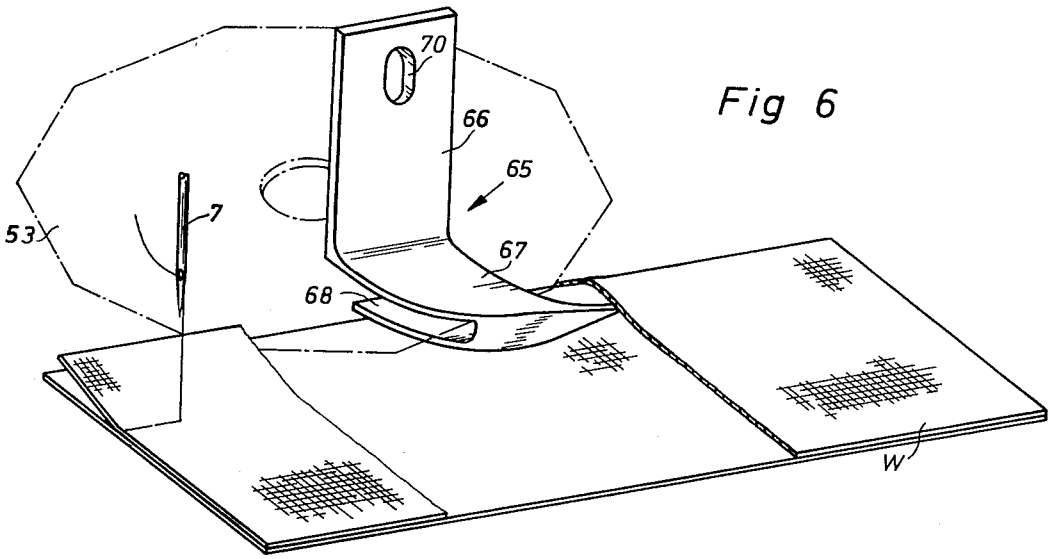
FIG. 6 is an enlarged partial perspective view of the guide spur in its operational position during cutting.

The sewing machine is not provided with its own feed mechanism. To displace the work fabric W, a known feed mechanism is provided which includes two longitudinal guide bars 10, 11 extending parallel to each other and which are secured to frame 1 below table plate 2 and a slide 14 driven by a chain 13 off a motor 12 is guided thereon. Two transverse guide bars 15 and 16, extending parallel to each other, are secured to the slide 14, and a support 17 is displaceably mounted thereon. Thus, support 17 is guided in the manner of a cross-slide. U-shaped arms 18 having legs of unequal length are secured to the two ends of support 17. The short legs of the two arms 18 are connected to support 17 while the long legs extend parallel to the longitudinal axis of sewing machine 3, above table plate 2 and are spaced therefrom. Pneumatic motors 19 and 20 are mounted on the respective free ends of the long legs of arms 18. A template rail 23 is disconnectably secured to respective piston rods 21 and 22 of two pneumatic motors 19 and 20. Template rail 23 comprises a pressure strip 24 which is provided, on its underside, with a soft drive coating to be placed on the fabric, and a guide blade 25. As shown in FIG. 2, guide blade 25 is conformable to the desired seam line S or to the shape of the tuck.

Figure 5:
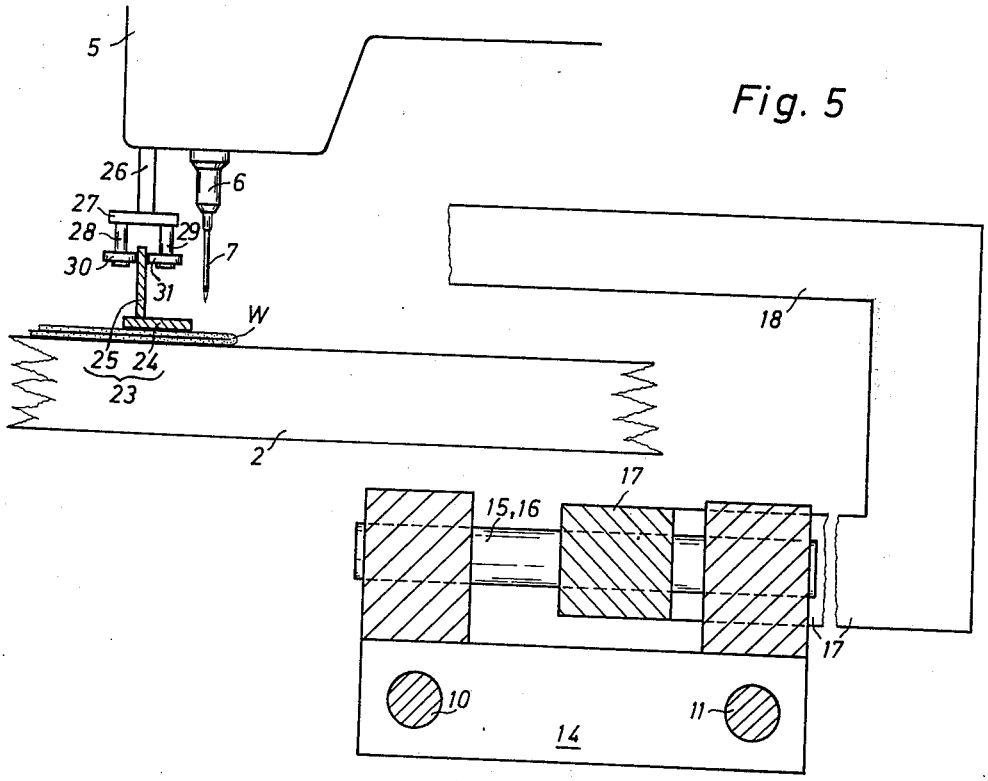
FIG. 5 is an enlarged sectional view taken along the line V—V of FIG. 1, but without the cutting mechanism being shown.

A vertical supporting rod 26, mounted in head 5 of the sewing machine 3, as shown in FIGS. 1 and 5, carries a plate 27 on its lower end having two template rail guide rollers 30, 31, each rotatable about a vertical axes 28 and 29. The guide blade 25 passes between rollers 30, 31 as template rail 23 is displaced.

An advance table 32 serves as a surface on which the work W is placed. The work is folded along the fold line predetermined for the tuck, and is advanced over the advance table 32. Advance table 32 comprises a table plate 33 extending in a plane parallel to the work receiving surface and between the work receiving surface and the pressure strip 24 of the template rail 23. An insert 35 is secured, for example, by soldering, at the edge 34 of a table plate 33 of advance table 32 which is near the template rail 23. At the left front side 36 of insert 35 (FIG. 2), edge 34 of advance table 32 is slightly offset and extends obliquely to the side edge of table plate 33.

Figure 3:
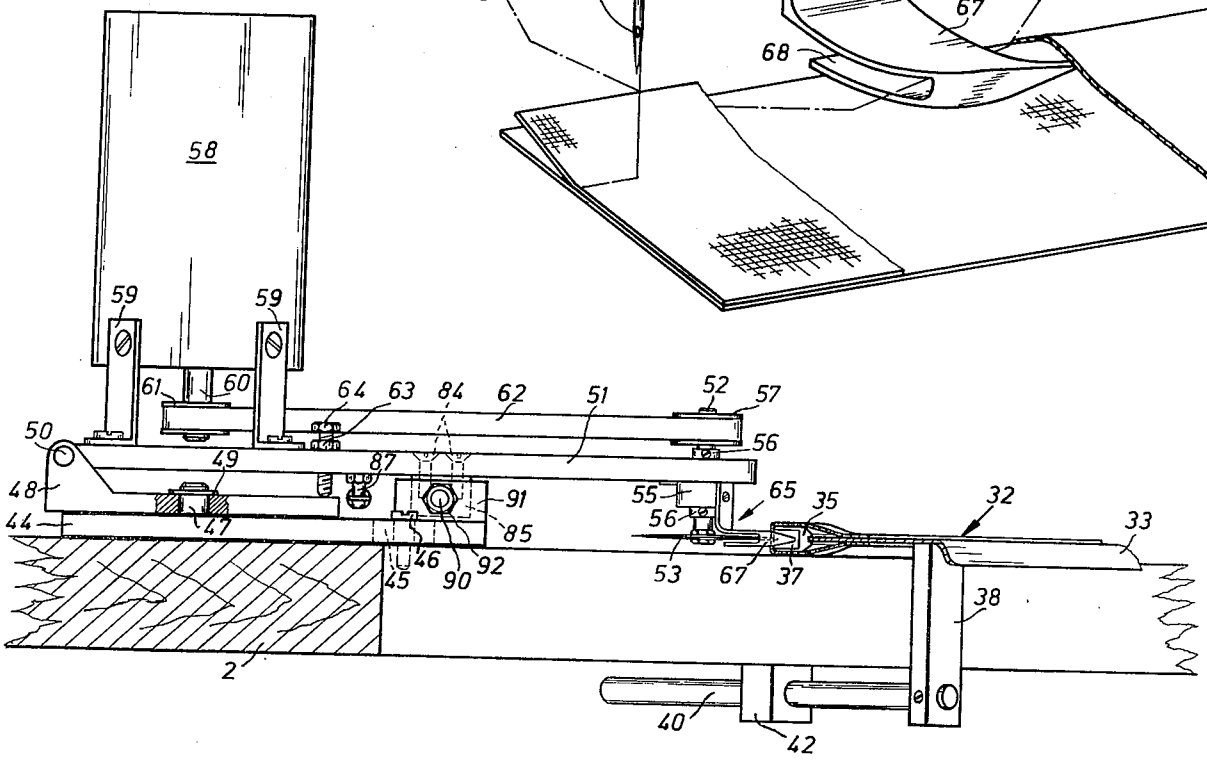
FIG. 3 is an elevational view, partly in section, taken in the direction of the arrow A in FIG. 2.
Figure 4:
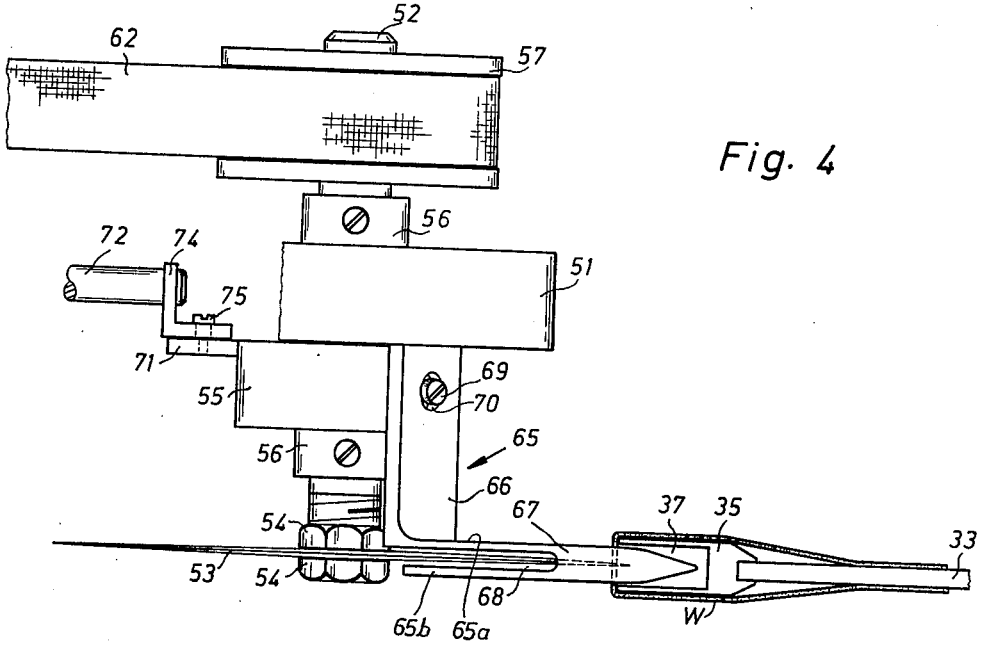
FIG. 4 is an elongated view of the cutting knife and spur guide.

As shown in FIGS. 3 and 4, in the zone adjacent its front side 36 (FIG. 2), insert 35 is provided with a recess 37 so that it comprises a forked portion which is open toward template rail 23 and toward front side 36.

Two supports 38 and 39 are provided on the underside of table plate 33, and sliding rods 40 and 41 are secured to each of them, respectively. Sliding rods 40, 41 are each guided in a respective guide block 42, 43 secured to the underside of table plate 2 and displaceable parallel to the latter in the direction of the arrow Z, in FIG. 2.

As shown in FIG. 2, the device for cutting open the doubled work W along the fold or break line while making the tuck comprises a base plate 44 which is secured to work supporting bed 4 of sewing machine 3 by means of screws 46 passed through longitudinal slots 45, as shown in FIGS. 2 and 3. A pivot 47 is fixed in base plate 44 and a supporting plate 48 is pivotally mounted thereon and secured against axial displacement by a clamping disc 49, see FIG. 3. A carrier plate 51 is pivotally mounted on supporting plate 48 by means of a horizontal hinge pin 50 and a shaft 52 is mounted on the free end of carrier plate 51. A cutting knife 53 designed as a multi-edge blade is secured to the threaded lower end of shaft 52 by means of two nuts 54. A bushing 55 is rotatably mounted on shaft 52 below carrier plate 51. Shaft 52, with bushing 55, is axially secured by two setting rings 56. Gear 57 is mounted on the upper end of shaft 52. A drive motor 58 drives shaft 52 and cutting knife 53 and it is secured to carrier plate 51 by means of four angles or supports 59. Shaft 52 of cutting knife 53 is driven through a gear belt 62 from a drive gear 61 mounted on shaft 60 of motor 58.

To adjust the distance of cutting knife 53 from the work supporting surface, a stop screw 64 is provided in carrier plate 51 which is adjustable by means of a lock nut 63.

A guide spur 65 is secured to bushing 55 which is rotatably mounted on shaft 52. Guide spur 65 comprises a vertical shaft portion 66 and a wedge-shape spur portion 67 extending at an angle thereto. The guide spur includes a top edge **65*a* and a bottom edge 65*b* formed with a tip projecting against the work in the feed direction, which is indicated by arrow V. To receive the cutting knife 53, spur portion 67 has a slot 68 between top and bottom edges 65*a* and 65*b* at the side remote from the tip. Thereby, guide spur 65 forms a counterblade for cutting knife 53. For vertical adjustment of guide spur 65, its fixing screw 69 is passed through a longitudinal slot 70 provided in shaft 66.**

The pivotal movement of guide spur 65, the spur portion 67 of which is to be swung between the fabric layers of work W folded around edge 34 of table plate 33 into recess 37 of insert 35, is effected by means of an actuating arm 71, (FIGS. 2 and 4), which is secured to bushing 55 and pivotally connected by a screw 75 to an angle piece 74 which is fixed to the piston rod 72 of a single-action pneumatic motor 73. Pneumatic motor 73 includes a connection 76 and is mounted unilaterally and pivotally on a pillow block 77, FIG. 2, which, in turn, is fixed to carrier plate 51. Piston rod 72 is loaded by a return spring 78 mounted thereon.

As seen in FIG. 2, a fixing flange 79, extending at an angle, is provided on base plate 44, and a single-action pneumatic motor 80 is mounted thereon for swinging carrier plate 51 with the parts arranged thereon about pivot 47. Pneumatic motor 80 comprises a connection 81, a piston rod 82 and a pressure piece 83 which is secured to piston rod 82 and acts on a pressure plate 85 which is fixed to the underside of carrier plate 51 by means of screws 84. Pressure plate 85 of carrier plate 51 is brought into contact with pressure piece 83 by means of a tension spring 86 which is attached on the one side to a stud 87 fixed to carrier plate 51 and, on the other side, by means of two nuts 88, to a stud 89 which is fixed to fixing flange 79.

To limit the pivotal movement of carrier plate 51 and to determine the depth of penetration of cutting knife 53 between the fabric layers of work W, a stop screw 90 is provided which cooperates with pressure piece 85. Stop 90 is screwed into a web 91 of base plate 44 and is adjustable by means of a nut 92.

As usual, pneumatic motors 19, 20, 73 and 80 are connected by flexible tubings to a compressed-air source (not shown) and are advantageously controlled by electromagnetically switchable valves. The valves, as well as sewing machine motor 8, feed motor 12 and motor 58 driving the cutting mechanism, may be controlled either manually or according to a predetermined program. The choice and arrangement of the valves, as well as the design of the control, is the same as conventionally used in such machines and therefore they are not illustrated.

Assuming that motors 8, 12 and 58 are switched off, the partial mechanisms are in their respective initial or rest positions in which table 32 and carrier plate 51 with cutting knife 53 and guide spur 65 occupy the positions indicated in FIG. 2 by dash-dotted lines and template rail 23 is lifted by the pneumatic motors 19 and 20, the device operates as follows: Work W, for example a jacket breastpiece, to be provided with a tuck shown for example in FIG. 7, is folded along the later cutting line of the tuck which, in general, is indicated by a marking line around front edge 34 of table plate 33 of advance table 32 and around recess 37 and, by means of advance table 32, it is passed below the lifted pressure strip 24 of template rail 23 into the position indicated in FIG. 2 in solid lines. Thereupon, template rail 23 is lowered on work W while leaving a free margin depending on the shape of the seam, whereby work W is engaged by friction contact.

Due to a corresponding switching arrangement, after actuating the switches of pneumatic motors 73 and 80, compressed air is supplied through their connections 76 and 81, whereby piston rod 72 of pneumatic motor 73 is displaced against the action of return spring 78 and bushing 55 with guide spur 65 is swung clockwise about shaft 52 so that spur portion 67 of guide spur 65 occupies the position shown in FIG. 2 in dash-dotted lines. Further, by piston rod 82 of pneumatic motor 80 and pressure piece 83 fixed thereon, and acting on pressure plate 85, carrier plate 51 is swung toward work W into the solid line positions shown in FIG. 2. Simultaneously, with a switching operation to clear the compressed air supply to pneumatic motors 73 and 80, drive motor 58 of cutting knife 53 is switched on and drives the cutting knife mounted on shaft 52 through gear 61, gear belt 62 and gear 57.

As soon as carrier plate 51 has reached its working position which is determined and adjustable by stop screw 90 and pressure plate 85, the compressed-air supply to pneumatic motor 73 is interrupted and the cylinder of pneumatic motor 73 is vented. Consequently, return spring 78 becomes effective. Under its action, piston rod 72 is pushed back into its initial position and, through actuating arm 71, bushing 55 with guide spur 65 is swung counterclockwise about shaft 52. At this swinging motion, the wedge-shaped spur portion 67 of guide spur 65 penetrates into recess 37 of insert 35 and thus between the two fabric layers of work W which has been folded around front edge 34 of advance table 32 and insert 35. The spur 65 is urged by return spring 78 from the inside of the folded fabric layers of work W against the fold edge of work W which, during the subsequent cutting operation, is thereby held slightly stretched relative to cutting knife 53. Advance table 32 is then moved back into its initial position, indicated in FIG. 2 in dash-dotted lines. To prevent an unintentional slipping of work W, retaining or pressure fingers (not shown) may be used to temporarily clamp the free margin of work W. Thereupon, by actuating a switch, first motor 12 is put into operation by which, through chain 13, slide 14 with support 17 and thereby, through arms 18, template rail 23 with frictionally engaged work W is displaced from the initial position according to FIGS. 1 and 2 in the direction of arrow V (FIG. 2).

During this displacement, work W is cut open along the fold or break edge except for the distance *a*, i.e., the part adjacent the point of the tuck which, for reasons of durability of the seam, is not cut open. During this operation, the guide spur 65 forms the counterblade or a countersupport for the cutting knife projecting into slot 68 in spur portion 67. A yielding of even very loosely woven or very thin, pliable fabrics relative to cutting knife 53 is thereby completely eliminated.

Shortly before the edge of work W aligned with lateral edge 36 of insert 35 has reached the stitch formation zone, motor 8 of driving sewing machine 3 through belt 9 is switched on, either by a key switch provided in the displacement path of work W or by photoelectric means. During this further displacement, the tuck seam, whose shape is determined by guide blade 25 of template rail 23 passing between guide rollers 30, 31, which are mounted on the sewing machine, is formed along the dash-dotted line S (FIG. 2). By a corresponding control of feed motor 12, the seam may be locked at both its ends by condensing the stitches or by a temporary reversal of the shifting direction.

During the displacement of template rail 23 with work W from the right-hand to the left-hand side (FIG. 2), the doubled work W is cut open along the fold or break edge, except for the distance *a* (FIG. 7) and the tuck seam is formed along line S.

To finish the cutting operation, automatically operating solenoid valves (not shown) are controlled, through appropriately arranged limiting switches (not shown) so as to supply pneumatic motor 73 with compressed air through connection 76 and with a short delay, for example, through a timing circuit, to interrupt the compressed-air supply to pneumatic motor 80, and drive motor 58 and, thereby, cutting knife 53 are switched off. The result is that, at the end of the cut, guide spur 65, which is fixed to bushing 55, is swung clockwise through actuating arm 71 so that the wedge-shaped spur portion 67 is withdrawn from its position between the fabric layers of work W and carrier plate 51 with the parts arranged thereon, under the action of tension spring 86, and they are swung back about pivot 47 into its initial position in which cutting knife 53 and guide spur 65 occupy the dash-dotted position shown in FIG. 2.

After completion of the seam along line S (FIG. 2), motors 8 and 12 are switched off, for example, by means of a limiting switch, provided in the displacement path of slide 14 and a corresponding circuit. Thereupon, template rail 23 is lifted from work W by a corresponding supply of compressed air to pneumatic motors 19, 20. Work W can then be removed and template rail 23 may be brought into its initial position, shown in FIGS. 1 and 2, by a corresponding switching on of feed motor 12 and the following work W to be treated which, in the meantime, has been folded along the fold edge to be subsequently cut open and around edge 34 of advance table 32, and is passed with the advance table below the lifted pressure strip 24 of template rail 23 into the position shown in FIG. 2 in solid lines. The cycle is then repeated.

It should also be noted that when not in use, the cutting mechanism can be brought into an idle position. To this end, only tension spring 86 is to be disconnected from stud 87. The entire device is then swung away about pivot 47. If necessary, carrier plate 51 with the parts arranged thereon may be swung up about hinge pin 50.

While a specific embodiment of the invention has been shown and described in detail to illustrate the application of the principles of the invention, it will be understood that the invention may be embodied otherwise without departing from such principles.

What is claimed is:

1. A device for use on a sewing unit in sewing and cutting open tucks of cut pieces of garments, comprising a sewing machine having a stitch formation zone, and a work advance table having an edge around which the work is folded, a template rail extending over said table which is conformable to the shape of the seam and adapted to be engaged on the work and which extends past the stitch formation zone of the sewing machine, a cutting knife which is introduceable between the fabric layers of the folded work, said work advance table being formed, at least partly, with a forked cross-section with spaced apart top and bottom legs having an opening therebetween, a guide spur having a flattened end engageable between the fabric of the folded work and having a slot therein for accommodating said cutter, and mounting means mounting said cutting knife and said guide spur for movement toward and away from said table.

2. A device for use on a sewing unit in sewing and cutting open tucks on cut pieces of garments, according to claim 11, said mounting means including a carrier plate, said cutting knife comprises a rotatable disc, a shaft carrying said disc rotatably mounted in said carrier plate, said guide spur being pivotable on said rotatable shaft.

3. A device for use on a sewing unit in sewing and cutting open tucks on cut pieces of garments, according to claim 1, wherein said guide spur forked cross-section is substantially flat and forms a counterblade for said cutting knife.

4. A device for use on a sewing unit in sewing and cutting open tucks on cut pieces of garments, according to claim 2, including a motor mounted on said carrier plate being connected to rotate said drive shaft, means for mounting said carrier plate for movement about a vertical axis and means for mounting said carrier plate for movement about a horizontal axis.

5. A device for use on a sewing unit in sewing and cutting open tucks on cut pieces of garments, according to claim 1, wherein said table includes an insert forming the forked cross-section thereof.

* * * * *